United States Patent [19]

Kölblin

[11] Patent Number: 4,641,829

[45] Date of Patent: Feb. 10, 1987

[54] SCREEN PRINTING MACHINE HAVING A STATIONARY PRINTING TABLE

[75] Inventor: Karl Kölblin, Emmendingen, Fed. Rep. of Germany

[73] Assignee: Werner Thieme GmbH & Co. KG, Fed. Rep. of Germany

[21] Appl. No.: 727,726

[22] Filed: Apr. 29, 1985

[30] Foreign Application Priority Data

Apr. 27, 1984 [DE] Fed. Rep. of Germany ..... 3415715

[51] Int. Cl.[4] ..... B65H 5/10

[52] U.S. Cl. ..... 271/268; 271/85; 414/251; 198/468.4

[58] Field of Search ..... 271/268, 269, 267, 264, 271/84, 85; 112/121.11, 121.12, 121.14, 121.15; 101/238; 198/468.4, 470.1, 475.1; 414/751, 749

[56] References Cited

U.S. PATENT DOCUMENTS

| | | | |
|---|---|---|---|
| 3,456,814 | 7/1969 | Bautz | 414/751 |
| 3,850,285 | 11/1974 | Johnson | 414/751 X |
| 3;960,276 | 6/1976 | Gerhardt | 198/468.4 X |
| 4,003,476 | 1/1977 | Laskey | 414/749 |

FOREIGN PATENT DOCUMENTS

| | | |
|---|---|---|
| 1248683 | 4/1963 | Fed. Rep. of Germany . |
| 1561049 | 2/1967 | Fed. Rep. of Germany . |

*Primary Examiner*—George E. A. Halvosa
*Assistant Examiner*—Lawrence J. Goffney, Jr.
*Attorney, Agent, or Firm*—Barnes & Thornburg

[57] ABSTRACT

A screen printing apparatus is provided for transferring sheet materials from a supply area to a printing table. The apparatus has a pair of grippers which are guided jointly over the printing table in a timed manner in order to grip a blank sheet at a feeding table and pull it over the printing table. The two grippers are separately guided above the printing table in such a way that their movements take place in opposite directions to one another and that one of the gripper fails passes over the other one in the area of the center of the printing table. This design has the advantage that during the transport by a first gripper of a sheet to be printed on the printing table, a second gripper rail already returns to its starting position. Therefore, when the printed sheet is removed from the printing table, a new sheet can be placed thereupon immediately. Idle times for the conveying of the sheets to be printed are eliminated with the use of only two grippers.

25 Claims, 8 Drawing Figures

SCREEN PRINTING MACHINE HAVING A STATIONARY PRINTING TABLE

BACKGROUND AND SUMMARY OF THE INVENTION

This invention relates generally to a screen printing machine having a stationary printing table and at least two gripper rails that are in motion at the same time. One rail is guided over the printing table in order to grip a new blank sheet at a feeding table during a printing operation, pull the sheet over the printing table after the printing operation, and position the sheet on the table. Subsequently, the rail is guided back to the feeding table.

Screen printing machines of the general type having a row of gripper rails on a joint conveyer are known in the art. The upper end of the conveyer extends in a plane above the printing table and the lower end extends in a plane below the printing table. The gripper rails, which are disposed transversely over the printing table with a gripped print sheet, are first guided over the printing table. The rails reach their starting position for gripping a new sheet only after angular deflection and return below the printing table. Screen printing machines of this type generally provide that these gripper rails also convey the printed sheet to a delivery station so that the deflection and return will start only after this conveyance. These machines are disadvantageous because the rail return path encompasses the whole lower part of the machine. Many gripper rails are required for one machine and the cost of construction and space requirements for machines of this type are relatively high.

Also known are other screen printing machines where a carriage is moved back and forth laterally of the printing table. The length of the carriage corresponds approximately to the length of the printing table and the carriage has gripper rails at each of its two ends that can operate on the same side. By means of this carriage, print sheets that are to be placed on the printing table can therefore be gripped by one rail and be conveyed over the printing table while the gripper rail disposed on the other side of the carriage can grasp an already printed sheet and convey it to the delivery point. However in this type of screen printing machine, it is a disadvantage that the carriage must move back empty for the purpose of gripping of a new sheet. Machines of this type therefore have relatively long idle time.

One objective of this invention is the provision of a screen printing machine that requires as few gripper rails as possible for the transport of print material on the printing table without the disadvantage of excessive idle times.

This and other objectives of the present invention are achieved by the provision of two gripper rails which are each separately guided over the printing table in a guideway but whose movements take place in opposite directions to one another. The guideways are designed in such a way that one of the gripper rails passes over the other one in the region of the center of the printing table. This design has the advantage that, during the transport of a sheet to be printed onto the printing table by a first gripper rail, the second gripper rail is already returning to its starting position. Therefore, during the removal of the printed sheet, a new sheet can be moved into position immediately.

It is advantageous for each gripper rail, to be connected with a driving means which is operated jointly with the driving means of the other gripper rail but in the opposite direction. It is also advantageous for the driving means to be connected to a joint endless conveyor to which the gripper rails are fastened at a distance corresponding to half the length of the endless conveyer.

This type of design ensures an opposing of movements without requiring separate drives for the two gripper rails. Advantageously, the endless conveyer is a rotating chain extending in the area of the guideways of the gripper rails. The gripper rails are provided at their two ends with guiding parts having pulleys running on guide rails serving as the guideways. This ensures exact guiding and steady movement of the gripper rails.

The opposing drive and the controlling of the lifting movement of one gripper rail over the other one may take place in different ways. It is contemplated that the driving and guiding wheels of the chain have horizontal axles and that the guide rails extend above one another in a vertical plane. This design has the advantage of a narrow construction. Tne guide rails in this case may advantageously be the inside edges of a slot extending laterally in an oblong chain case receiving the chain. The slot is designed symmetrically relative to the center of the longitudinal edges of the printing table and open in the direction of the printing table. This combines covering and protection of the chain to the outside with the arrangement of the guideways for the gripper rails. The slot must be wider in its center region than in its end regions to a degree that is sufficient for letting the guide parts of the gripper rails pass over one another.

In addition, biasing means are provided in order to press the guiding parts against the lower inside edge of the slot during movement in one direction and against the upper inside edge of the slot during the movement into the other direction. In this way, the passing of the guiding parts of the gripper rails and thus also of the gripper rails themselves in their path of motion is ensured. As biasing devices, guide tracks may be provided on which the pulleys of the guide parts are lifted while travelling in one direction, while during the return, they pass below this guideway. However, it is simpler and less susceptible to disturbances or misguiding when a pair of pivoted levers is provided as the biasing device. The levers are coupled to the chain at the joint pivotal point. The free ends of the pivoted levers are arranged in the guide part of the gripper rail so that they can be slid in parallel to the direction of movement of the gripper rails. The free ends of the pivoted levers are biased via a pressure spring or similar means toward a position such that they seek alignment with one another.

This design has the advantage that the pair of pivoted levers, which at the joint pivotal point is forcibly guided at the assigned end of the belt, constantly exercises a biasing force on the guide part which constantly attempts to bias the guide part in the direction of the assigned end of the chain. In this way, the contact of the guide part or its pulleys with the outside contour of the slot is always ensured. This design also has the advantage that at the two deflecting points of the chain, the pivoted levers are forced into their stretched position thereby relieving the pressure spring. The pivoted levers then swing into the opposite direction and again exercise a pulling force on the guide part as caused by the rotating motion of the chain. The guide part of each gripper rail arranged on the chain in this way is thus forcibly guided at the outer edge of the slot assigned to it. The guide parts therefore forcibly move past one another in the widened center area of the slot without touching. On both sides of this crossing point, the guide parts extend in such a way that the gripper rails, are guided flatly over the printing table in the desired manner.

It is advantageous to dispose the free ends of the pivoted levers at sliding blocks which are guided in a longitudinal guide in a guiding carriage serving as the guide part. The guiding carriage in the desired manner is then guided in the slot. In the region of the center of the slot, as a precaution, a separating web may also be arranged between the lower and the upper inside edge of the slot in order to avoid a mutual contact of the guiding carriage of the two gripper rails moving in opposite directions.

Alternatively, it is provided that the driving and guiding wheels of the chain have vertically extending axles and that the guide rails extend in parallel next to one another. This design has the advantage that biased pivoted levers are not required. Advantageously, one of the guide rails in the area of the center of the side edge of the printing table, is placed higher than the adjacent guide rail by a degree that corresponds to at least approximately the height of one gripper rail. In this manner, when the gripper rails pass through the path of the guide rails which are arranged in an oval, the gripper rails run above one another in the center of their paths in the desired manner of motion.

In order to achieve this, it may be provided that the pulleys of the guide parts, are connected with carrying parts for the ends of the gripper rails via vertically extending support parts. The support parts are guided vertically and slidably in driving means which are firmly connected with the chain. The carrying parts are connected with the support parts via shifting elements permitting a horizontal motion of the support parts by the degree of the distance of the adjacent ends of the chain. In a simple manner, the carrying parts may be designed as link tongues, and the shifting elements may be designed as swivel arms that can be rotated around a vertical axis. The swivel arms are connected with the assigned support part, such that the swivel point of the swivel arms at the link tongues will then be located in a vertical plane going through the axles of the deflecting and driving wheels. A simple realization of this embodiment can be achieved when the support parts are designed as cylindrical support rods which are guided rotatably and slidably in bushings serving as driving means and the swivel arms are firmly connected with the support rods. In order to achieve a better guiding of the support rods via a longer bushing, it is also contemplated that the bushings be fastened at two jointly driven chains disposed below one another in horizonatal planes, thus having a greater length.

Further objects, features, and advantages of the present invention will be come more obvious from the following description when taken in conjunction with the accompanying drawings.

DETAILED DESCRIPTION OF THE DRAWINGS

Figure 1:
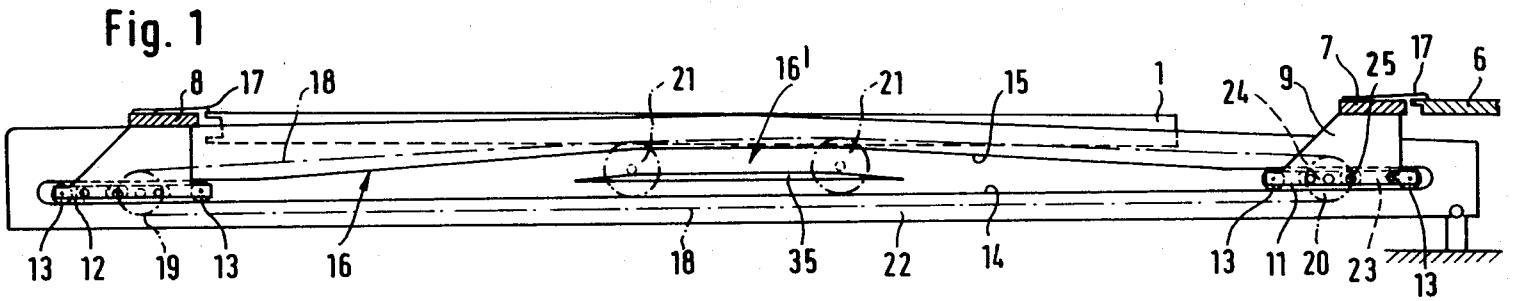
FIG. 1 shows a side view of the gripper rail guiding system of a new screen printing machine with the gripper rails in the printing position and the feeding position, with a driving chain rotating in a vertical plane.
Figure 2:
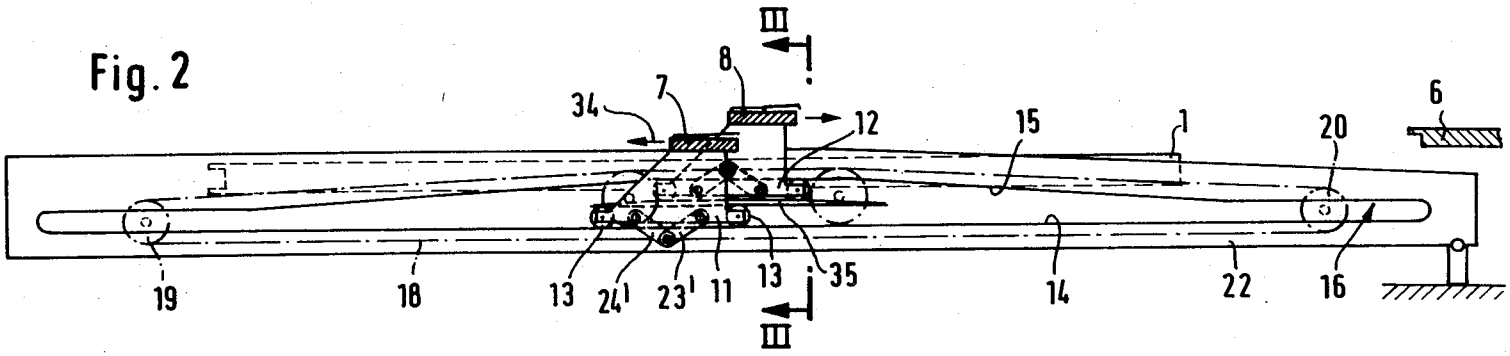
FIG. 2 shows a side view of the gripper rails during the passage through the center of the guideway.
Figure 3:
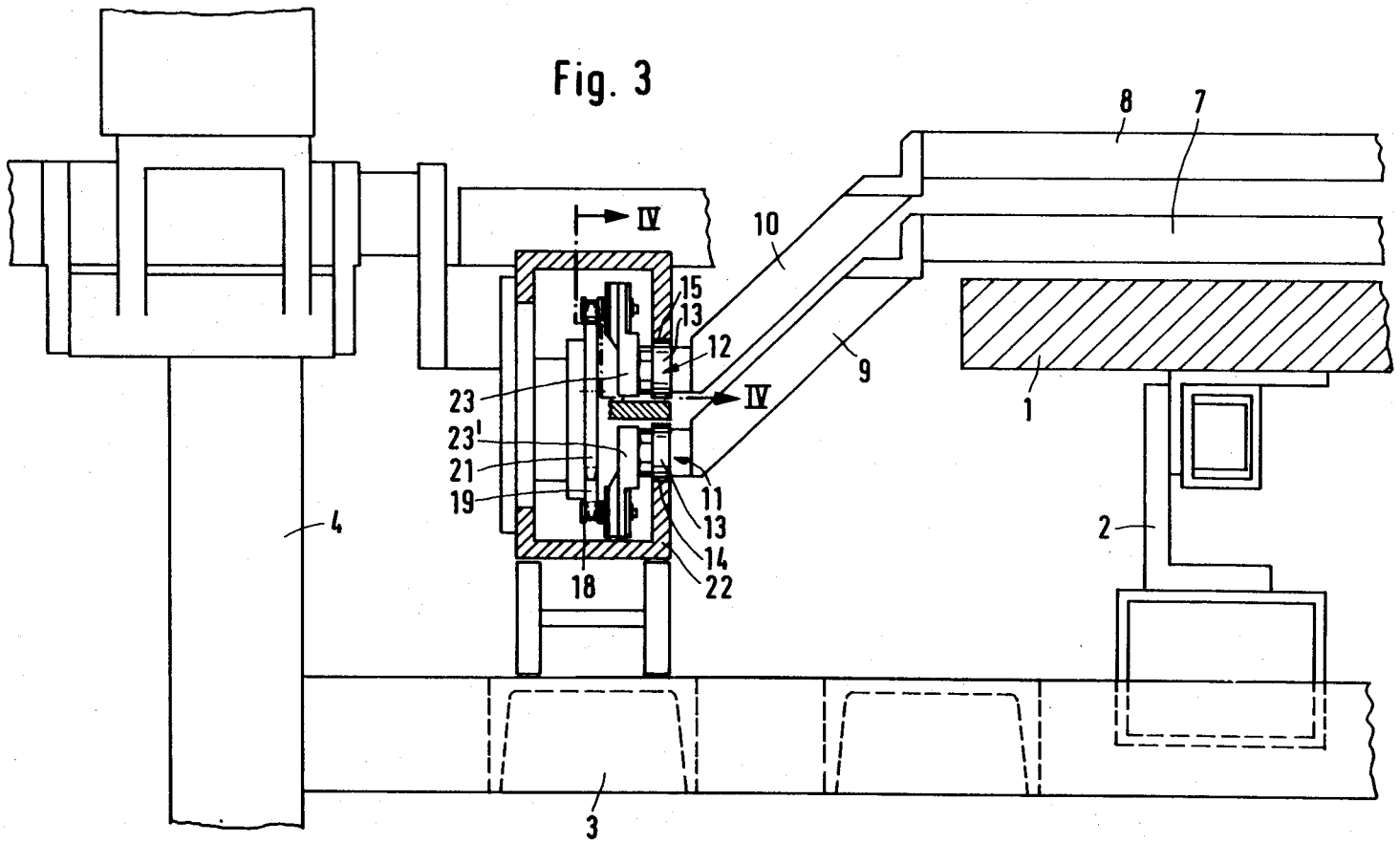
FIG. 3 is an enlarged section according to Line III—III in FIG. 2.

In FIGS. 1 and 2, the lateral guiding arrangement for two gripper rails of a screen printing machine in accordance with the present invention is shown. The basic construction of the remainder of the machine corresponds to that of a conventional screen printing machine having a stationary printing table and is therefore not shown. However, FIG. 3 shows that the printing table 1 is disposed, via support carriers 2 of conventional construction, in machine stand 3 which has lateral walls 4 for supporting a squeegee (not shown in detail) and the screen frame disposed underneath. The sheets of paper, cardboard or similar material are arranged manually or mechanically in known manner on feeding table 6. The sheets to be printed are then gripped by gripper rails 7 and 8 and transported to the printing table 1. In a first embodiment of the present invention, the arrangement of FIGS. 1 to 5 is used for the control of the movement of gripper rails 7 and 8.

As shown in FIGS. 1 and 2, the gripper rails 7 and 8 are each provided at their ends, with support carriers 9 and 10. Each support carrier is connected with a guiding carriage 11 and 12 which has two guiding wheels 13. The guiding carriages 11 and 12 move on guideways which are formed by the lower inside edges 14 and the upper inside edges 15 of a slot 16. At both its ends, the slot has a width that is slightly larger than the diameter of the wheels 13. At its center, in the area designated as 16', the slot has a width which is more than double the diameters of the pulleys.

In the starting position shown in FIG. 1, the gripper rail 7 is located at its right end position in front of the feeding table 6 in order to clamp a sheet (not shown but placed on the feeding table) at its edge by means of grippers 17. The second gripper rail 8, at this point in time, is located at the left end of the slot 16 in a position in which it has just placed a sheet to be printed on the printing table. This sheet is being printed at this point in time, and in a known manner is held at the printing table 1 by a vacuum. In addition, the sheet may also be held by means of the clamping strip 17 of the gripper rail 8. In this left end position, the gripper rail 8 is disposed in such a way that it does not interfere with the squeegee that is moved over the printing table 1.

From the position shown in FIG. 1, the gripper rail 7 is moved, after completion of the printing operation, into the position which in FIG. 1 is still taken up by the gripper rail 8. On the other hand, the gripper rails 8, as shown in FIG. 2, is moved in the opposite direction into the position which in FIG. 1 is taken up by the gripper rail 7. In order to achieve this sequence of movements, the guiding carriages 11 and 12 of the gripper rails 7 and 8 are each connected with a chain 18 which is housed in a case-type carrier 22 along with driving wheel 19 and deflecting and guiding pulleys 20 and 21 having horizontal axles. In the direction of the printing table 1, the housing is provided with open slot 16.

Figures 4, 5:
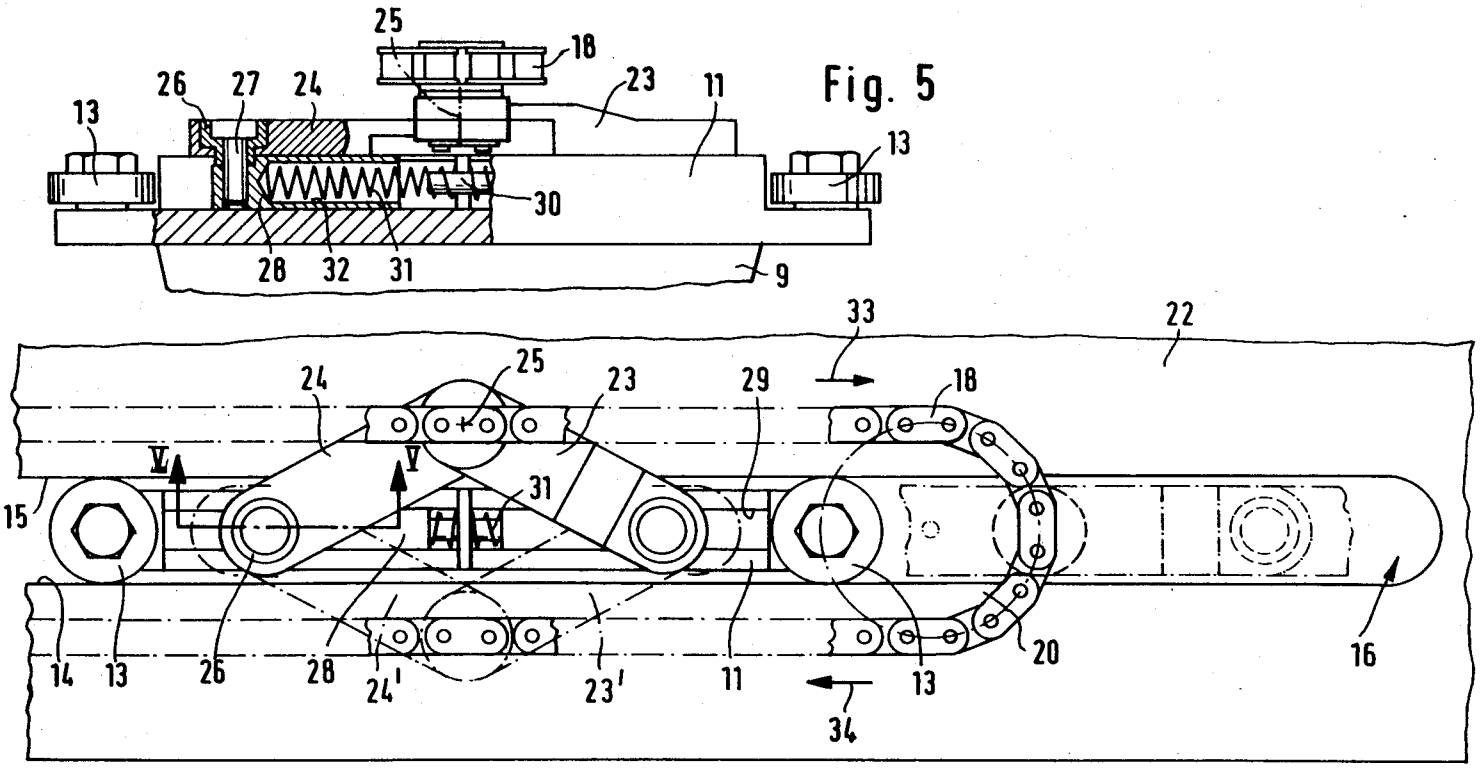
FIG. 4 is a view in the direction of the sectional Line IV—IV in FIG. 3 of a guiding carriage of a gripper rail and a biasing device in the area of the right end of the driving chain and the guideway.
FIG. 5 is a partially cut bottom view of the guiding carriage of FIG. 4.

As shown in detail in FIGS. 4 and 5, the guiding carriage 11 of the gripper rail 7 (and in the same way, the guiding carriage 12 of the gripper rail 8) is guided via a pair of pivoted levers 23, 24 which are firmly connected with the chain 18 at their joint pivotal shaft. At their free ends, the pivoted levers 23 and 24 are each rotatably connected with sliding blocks 28 via a bushing 26 and a screw 27. The blocks are longitudinally and slidably guided in rectangular groove 29 of the guiding carriage 11 using a dovetailed guiding or similar method. Between the two sliding blocks, a pressure spring 31 is disposed on a guide bolt 30. The pressure spring 31 projects into a blind bore 32 in the sliding blocks 28 and forces apart the two sliding blocks 28 which are each connected with the ends of the pivoted levers 23 and 24. In this manner, the guiding carriage 11 is pulled toward the upper end of the chain 18 via the pivoted levers 23 and 24 and the force exerted by spring 31 in its stretched out position shown in FIG. 4. The guide wheels 13 of carriage 11 therefore rest against the upper inside edge 15 of the slot 16. The pivoted levers 23 and 24, are moved into a stretched position (see FIG. 1) when the chain 18 is deflected at the deflecting wheel 20, because their pivotal shaft 25 is attached to the chain 18. From this stretched position, the pivoted levers, due to the continued movement of the chain, then reach the dash-dotted position 23', 24' in which their joint pivotal shaft 25' is moved toward the left at the lower end of the chain 18. Starting from this point in time, the pivoted levers 23', 24' exercise a pulling effect via the force of the spring 31 on the guiding carriage 11 in the downward direction. Accordingly, after the deflection (position of the gripper rail 7 in FIG. 1), the guide wheels 13 of the guiding carriage 11 are guided at the lower inside edge 14 of the slot.

Through this design, it is possible to guide the guiding carriages 11 during the movement of the gripper rail 7 in the direction of the Arrow 34 at the lower inside edge 14 of the slot 16, while the guiding carriage 12 of the other gripper rail 8 which analogously is connected with the chain 18, is guided at the upper inside edge 15 of the slot 16. Since tne slot 16 has a larger width in region 16', the two guiding carriages 11 and 12 (see FIG. 2) can be guided past one another. In this manner, the gripper rail 7 passes under the gripper rail 8, as also shown in FIG. 3. In order to reliably prevent contact of the two guiding carriages 11 and 12 in the region 16' of the slot 16, a deflecting rail 35 is also provided between the upper and the lower guideway.

As also demonstrated by the above description, the guiding carriages 11 and 12 must each be fastened to the chain 18 in such a way that identically long chain sections are located between them. It is only then that the guiding carriages each simultaneously reach the end position shown in FIG. 1 and cross each other in the area 16' in the center of the slot 16 (corresponding approximately to the center of the printing table 1).

By means of this design, no idle time will exist for the return of the gripper rail to the feeding table 6. The printed sheet is pulled off the printing table 1 in the direction of the arrow 34 by a withdrawal device (not shown) while the gripper rail 7 has already begun pulling a new sheet onto the printing table 1 for a subsequent printing operation as shown in FIG. 2.

Figure 6:
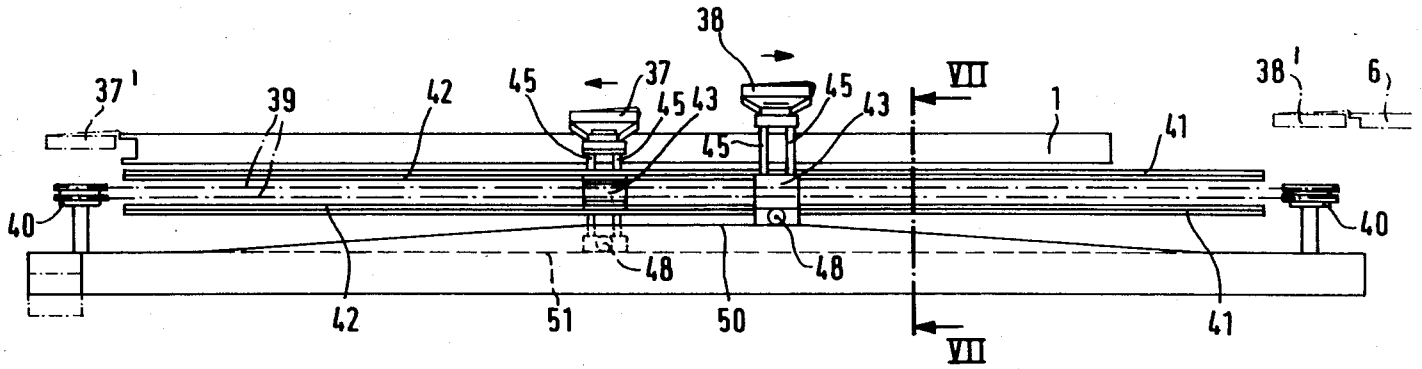
FIG. 6 shows a side view of a gripper rail guiding system with a chain drive disposed in a horizontal plane.
Figure 7:
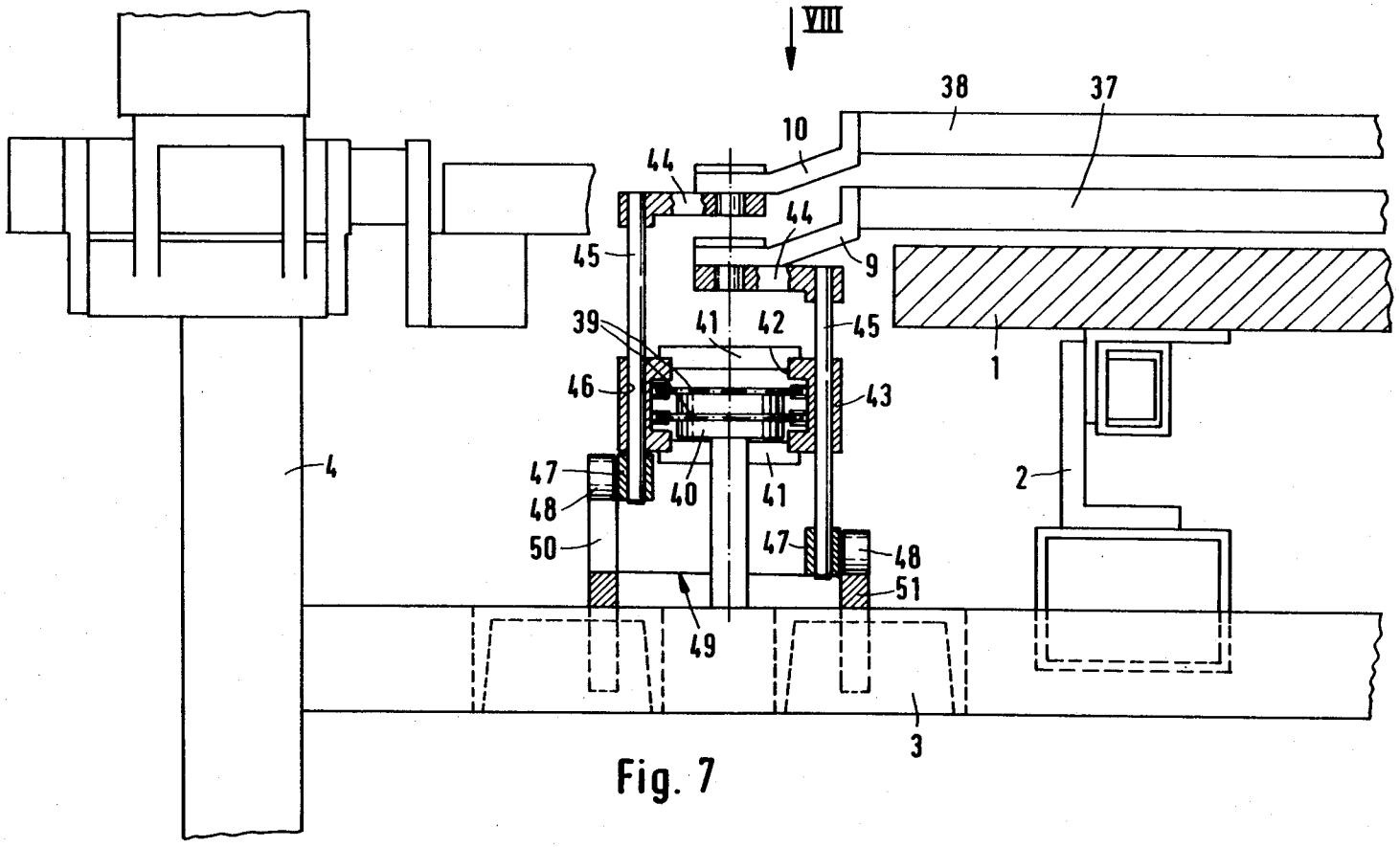
FIG. 7 is the enlarged representation of the section according to Line VII—VII through FIG. 6.
Figure 8:
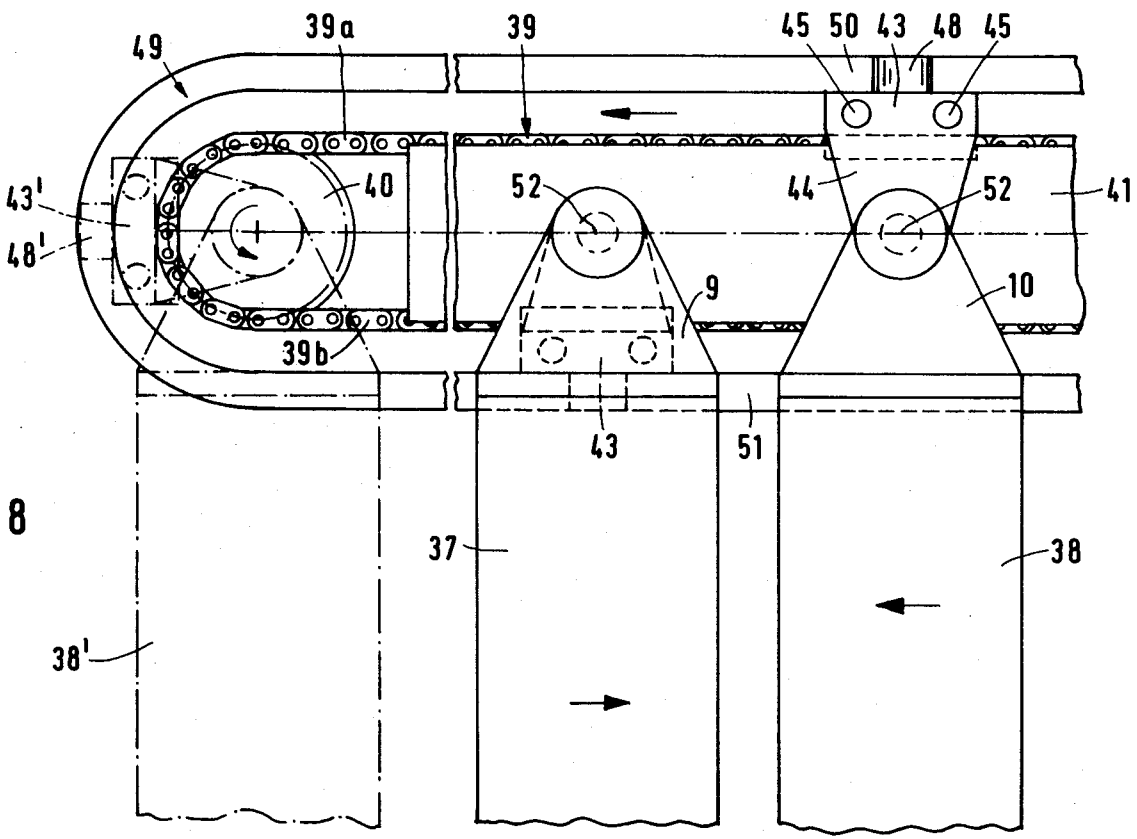
FIG. 8 is a top view of a gripper rail guiding system shown in FIG. 6 in accordance with the present invention.

In FIGS. 6 to 8, an alternate construction in accordance with the present invention is shown, by means of which the same sequence of movements of the gripper rails 37 and 38 is provided. In the case of the construction of FIG. 1 to 5, the chain 18 used for the drive rotates in a vertical plane, because the deflecting and driving pulleys 19, 20 have a horizontal shaft. In the case of the construction of FIGS. 6 to 8, a double chain 39 is provided which rotates around two deflecting and driving wheels 40 having vertical axles. This double chain 39 is guided within a protective case 41, the top and bottom side of which are provided with guiding edges 42 for bushings 43. In a manner similar to that of the joint pivotal shafts 25 in the construction of FIGS. 1 and 5, these bushings are each firmly connected to the double chain 39, so that identically long chain sections are located between each of them in both directions of the chain. This arrangement, like the one in the first construction, has the effect that the gripper rails 37 and 38 connected to the guide bushings 43, cross one another midway between the deflecting and driving wheels 40 during their forced movement in the direction of the rotation of the chain 39.

In order to achieve this crossing, the gripper rails 37 and 38 are each again connected by means of fastening tongues 9 and 10 with a driving means comprising, a pivoted lever 44 that is pivoted at the tongues 9 and 10, and firmly connected to two vertically extending support rods 45 which are longitudinally and slidably guided in bores 46 of the bushings 43. At their lower ends, the rods are equipped with stationary sleeves 47 each carrying a guide wheel 48. Said guide wheels 48 roll along an oval guideway 49 that is adapted to the contour of the double chain 39. One straight rail piece 50 of said guideway 49 is higher than the opposite rail section 51 so that the wheel 48 moving on rail 50 lifts the support rod 45 with pivotal level 44 via the sleeve 47, higher than the wheel 48 moving on the rail 51. This results in the lifting of gripper rail 38 over the other gripper rail 37. FIG. 6 shows that the guide wheel 48 of the gripper rail 38 facing the viewer moves on the elevated part of the guide rail 40 shortly after the crossing of the gripper rail 37. At the same time, the path 51 assigned to gripper rail 37 is flat so that the guide wheel 48 guides the assigned gripper rail 37 at a lower level, as shown in FIG. 7.

FIG. 8 shows that the double chain 39, during its rotation, carries the bushings 43 which are guided at the guideways 42 of the cover 41 and at the corresponding bottom side of the cover of the chain. The bushings 43 are also deflected at the deflecting wheel 40 so that the gripper rail 38 takes up position 38' in which the bushing assigned to it takes up position 43' and the asisgned guide wheel takes up position 48'. In this end position of the gripper rail 38 which may, for example, correspond to the end position in front of the feeding table 6 in FIG. 6, the other gripper rail is in end position 37' (FIG. 6) in which it has pulled a sheet to be printed over the printing table 1. When the chain 39 starts again after the printing operation, the lever 44 makes a complete rotation into the position which in FIG. 8 is still shown for the gripper rail 37. The gripper rail therefore, rolls along the path 51 with its assigned guide wheel 48, and is guided below the other gripper rail which at this time is carrying out a return movement. The remainder of the operation corresponds to that of the construction of FIGS. 1 to 5.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. A screen printing apparatus having transfer means for repeatedly transferring sheet material from a supply means to a printing table during a printing operation, said transfer means comprising:

first and second mobile gripper means for gripping said sheet material;

guideway means for guiding said first and second gripper means over said printing table;

said first gripper means being guided in a direction oppposite to said second gripper means, and said first gripper means being guided over said second gripper means at a center region of said guideway means; and driving means for moving said gripper means, said driving means being capable of moving said first gripper means in a direction opposite said second gripper means, said driving means comprising endless conveyor means, said first and second gripper means being connected to said conveyor means at a separation equal to one-half the length of said conveyor means.

2. A screen printing apparatus according to claim 1, wherein said endless conveyor means comprises rotatable chain means adajacent said guideway means.

3. A screen printing apparatus according to claim 1, wherein said gripper means are each equipped with guide part means, said guide parts having wheels for moving along said guideway means.

4. A screen printing apparatus according to claim 3, wherein said guideway means comprises guide rail means.

5. A screen printing apparatus according to claim 1, said driving means comprising rotatable chain means driven by driving wheel means having horizontal drive axles.

6. A screen printing apparatus according to claim 1, wherein said guideway means comprises first and second guide rail means, said first guide rail means being disposed above said second guide rail means in a vertically extending plane.

7. A screen printing apparatus according to claim 1, further comprising rotatable chain driving means for driving said gripper means, said chain driving means being driven by driving wheel means having vertical drive axles.

8. A screen printing apparatus having transfer means for repeatedly transferring sheet material from a supply means to a printing table during a printing operation, said transfer means comprising:

first and second mobile gripper means for gripping said sheet material;

guideway means for guiding said first and second gripper means over said printing table, said first gripper means being guided in a direction opposite to said second gripper means, and said first gripper means being guided over said second gripper means at a center region of said guideway means, said gripper means being each equipped with guide part means, said guide part means having wheels for moving along said guideway means, said guideway means comprising guide rail means; and driving means, said driving means comprising rotatable chain means driven by driving wheel means having horizontal drive axles, said guideway means comprising first and second guide rail means, said first guide rail means being disposed above said second guide rail means in a vertically extending plane.

9. A screen printing apparatus according to claim 8, further comprising oblong chain case means having a longitudinally extending slot adjacent said chain means, said guide rail means being inside edges of said slot. extending slot adjacent said chain means, said guide rail means being inside edges of said slot.

10. A screen printing apparatus according to claim 9, wherein a midpoint of said longitudinally extending slot and a midpoint of a longitudinal edge of said printing table lie in a single vertically extending plane.

11. A screen printing apparatus according to claim 10, wherein said slot has a center region having a greater width than end regions of said slot, said center region accommodating passage of a first guide part of said first gripper means over a second guide part of said second gripper means, said first and second guide parts forming at least portions of said guide part means.

12. A screen printing apparatus according to claim 11, wherein said first guide part means has biasing means for biasing said first guide part against an upper inside edge of said slot and said second guide part has a second biasing means for biasing said second guide part against a lower inside edge of said slot.

13. A screen printing apparatus according to claim 12, wherein said first and second biasing means comprise a pair of pivotable levers joined at a joint pivot point, said joint pivotable point attached to said chain means, free ends of said pivotable levers being arranged in said guide part means of said gripper means, said free ends of said pivotable levers being outwardly biased.

14. A screen printing apparatus according to claim 13, wherein said free ends of said pivotable levers are biased apart by spring means.

15. A screen printing apparatus according to claim 13, wherein said guide part means comprises guiding carriage means having a longitudinal guide, said free ends of said pivotable levers being disposed in sliding box means guided in said longitudinal guide.

16. A screen printing apparatus according to claim 9, further comprising separating web means arranged in said center region of said slot for preventing contact between said first and said second guide parts.

17. A screen printing apparatus having transfer means for repeatedly transferring sheet material from a supply means to a printing table during a printing operation, said transfer means comprising:

first and second mobile gripper means for gripping said sheet material;

guideway means for guiding said first and second gripper means over said printing table, said first gripper means being guided in a direction opposite to said second gripper means, and said first gripper means being guided over said second gripper means at a center region of said guideway means, said gripper means being each equipped with guide part means, said guide part means having wheels for moving along said guideway means, said guideway means comprising guide rail means; and rotatable chain driving means for driving said gripper means, said chain driving means being driven by driving wheel means having vertical drive axles.

18. A screen printing apparatus according to claim 17, wherein said guide rail means has two parallel sections extending next to one another.

19. A screen printing apparatus according to claim 18, wherein a center region of one said guide rail section is elevated relative to the other guide rail section, said elevation permitting passage of one gripper means over another gripper means.

20. A screen printing apparatus according to claim 18, wherein said gripper means are attached to carrying part means, said carrying part means being connected to vertically extending support part means, said support part means being slidably guided in driving means attached to said chain means, a bottom portion of said vertically extending support means being connected with said guide part means having said wheel means, tnereby permitting horizontal movement of said gripper means when said chain means is driven.

21. A screen printing apparatus according to claim 20, wherein said gripper means are attached to said vertically extending support part means through carrying part means said carrying part means being swivelably connected with said support part means.

22. A screen printing apparatus according to claim 20, wherein said support part means comprise cyclindrical support rods, said support rods being rotatably guided in driver bushing means.

23. A screen printing apparatus according to claim 22, wherein said chain driving means comprises double chain means having first and second chains, said first chain located above said second chain, said bushing means being connected to said double chain means.

24. A screen printing apparatus according to claim 23, wherein said support rod means is connected to sleeve means, said sleeve means supporting said guide wheel means.

25. A screen printing apparatus according to claim 24, wherein said guide rail means are arranged in an oval course corresponding to a configuration of said chain means.

* * * * *